US010775734B2

(12) United States Patent
Murota

(10) Patent No.: US 10,775,734 B2
(45) Date of Patent: Sep. 15, 2020

(54) IMAGE FORMING APPARATUS WITH PLURAL COVERS AND A LOCK CONTROL UNIT

(71) Applicant: KYOCERA Document Solutions Inc., Osaka (JP)

(72) Inventor: Mayuko Murota, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 16/531,791

(22) Filed: Aug. 5, 2019

(65) Prior Publication Data

US 2020/0050141 A1 Feb. 13, 2020

(30) Foreign Application Priority Data

Aug. 9, 2018 (JP) ..... 2018-149850

(51) Int. Cl.
*G03G 21/16* (2006.01)
*G03G 15/00* (2006.01)

(52) U.S. Cl.
CPC ..... *G03G 21/1633* (2013.01); *G03G 15/50* (2013.01); *G03G 15/5016* (2013.01); *G03G 15/5091* (2013.01); *G03G 15/70* (2013.01); *G03G 21/1638* (2013.01)

(58) Field of Classification Search
CPC ..... G03G 15/50; G03G 15/5016; G03G 15/5091; G03G 15/70; G03G 21/1633; G03G 21/1638
See application file for complete search history.

(56) References Cited

U.S. PATENT DOCUMENTS

2010/0290088 A1* 11/2010 Ito ..... G03G 15/55 358/1.16
2016/0291534 A1* 10/2016 Maeda ..... G03G 21/1633
2017/0006174 A1 1/2017 Miyaji

FOREIGN PATENT DOCUMENTS

JP 2017-013325 1/2017

* cited by examiner

*Primary Examiner* — Joseph S Wong

(57) ABSTRACT

Plural covers installed on a housing are capable of being opened and closed. Cover lock units lock and unlock a predetermined cover among the plural covers in accordance with a control signal. A lock control unit controls the cover lock units and changes a status of the cover among lock status and unlock status. The plural covers include a first cover, a second cover, and a third cover. On the first cover, the cover lock unit is not installed. On the second cover, the cover lock unit is installed and a predetermined user and a service person are allowed to unlock the second cover. On the third cover, the cover lock unit is installed and the service person is allowed to unlock to the third cover. The lock control unit determines whether the lock control unit unlocks the second cover or not on the basis of a user level.

3 Claims, 4 Drawing Sheets

IMAGE FORMING APPARATUS WITH PLURAL COVERS AND A LOCK CONTROL UNIT

CROSS-REFERENCE TO RELATED APPLICATIONS

This application relates to and claims priority rights from Japanese Patent Application No. 2018-149850, filed on Aug. 9, 2018, the entire disclosures of which are hereby incorporated by reference herein.

BACKGROUND

1. Field of the Present Disclosure

The present disclosure relates to an image forming apparatus.

2. Description of the Related Art

An image forming apparatus includes a cover for a user to remove a jammed printing sheet when a printing sheet jam occurs, and locks the cover using a lock mechanism so as to prevent the cover from being opened when a printing sheet jam occurs, and unlocks the cover if a predetermined-year-old user or older inputs login information.

However, in the aforementioned image forming apparatus, every user who is the predetermined years old or older can unlock the cover, and therefore a manual operation for resolving the trouble may not be performed properly by a user who is not familiar to a structure of the apparatus.

SUMMARY

An image forming apparatus according to an aspect of the present disclosure includes plural covers installed on a housing, plural cover lock units, and a lock control unit. The plural covers are capable of being opened and closed. The plural cover lock units are configured to lock a predetermined cover among the plural covers and unlock the predetermined cover in accordance with a control signal. The lock control unit is configured to control the cover lock units and thereby change a status of the cover from one to the other among lock status and unlock status. The plural covers include a first cover, a second cover, and a third cover, the first cover on which the cover lock unit is not installed, the second cover on which the cover lock unit is installed and that a predetermined user and a service person are allowed to unlock, the third cover on which the cover lock unit is installed and that the service person is allowed to unlock. The lock control unit determines whether the lock control unit unlocks the second cover or not on the basis of a user level of either a user who is in login status or an authenticated user.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
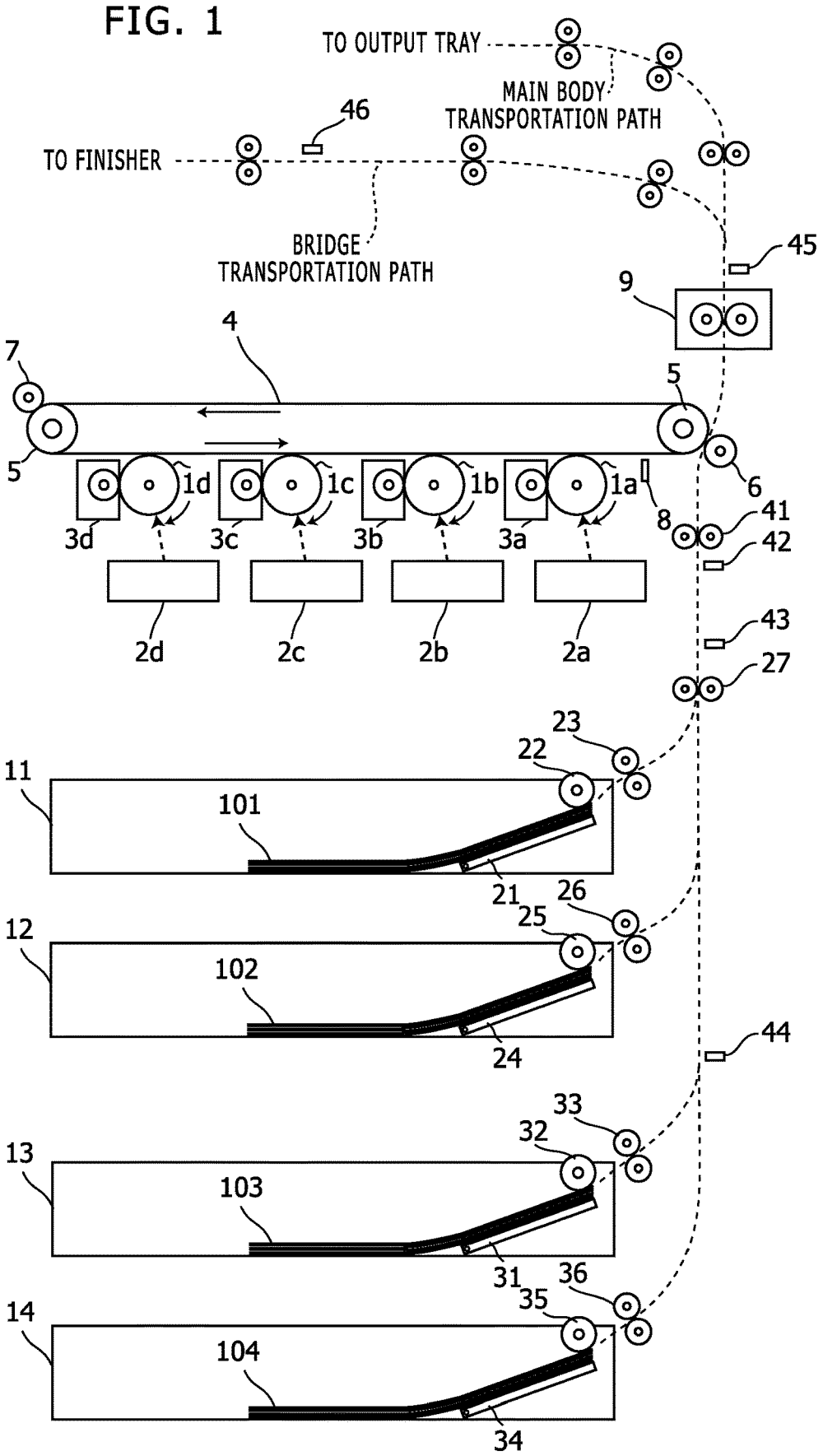
FIG. 1 shows a side view that indicates a partial internal mechanical configuration of an image forming apparatus in an embodiment according to the present disclosure.

FIG. 1 shows a side view that indicates a partial internal mechanical configuration of an image forming apparatus in an embodiment according to the present disclosure. The image forming apparatus shown in FIG. 1 is an apparatus having an electrophotographic printing function, such as a printer, a facsimile machine, a copier or a multi function peripheral.

The image forming apparatus in this embodiment includes a tandem-type color development device. This color development device includes photoconductor drums 1*a* to 1*d*, exposure devices 2*a* to 2*d*, and development devices 3*a* to 3*d*. The photoconductor drums 1*a* to 1*d* are photoconductors of four colors: Cyan, Magenta, Yellow and Black.

The exposure devices 2*a* to 2*d* are devices that form electrostatic latent images by scanning and irradiating the photo conductor drums 1*a* to 1*d* with laser light, respectively. The photo conductor drum 1*a*, 1*b*, 1*c* or 1*d* is scanned with the laser light in a direction (a primary scanning direction) perpendicular to a rotation direction (a secondary scanning direction) of the photoconductor drum. The exposure devices 2*a* to 2*d* include laser scanning units that include laser diodes as light sources of the laser light, optical elements (such as lens, mirror and polygon mirror) that guide the laser light to the photoconductor drums 1*a* to 1*d*, respectively.

Further, the periphery of each one of the photo conductor drums 1*a* to 1*d* includes a charging unit such as scorotron, a cleaning device, a static electricity eliminator and the like. The cleaning device removes residual toner on each one of the photo conductor drums 1*a* to 1*d* after primary transfer. The static electricity eliminator eliminates static electricity of each one of the photoconductor drums 1*a* to 1*d* after primary transfer.

The development unit 3*a*, 3*b*, 3*c* or 3*d* includes a toner cartridge and a development device. The toner cartridge contains toner of one of four colors: Cyan, Magenta, Yellow, and Black. The toner is supplied from a toner hopper in the toner cartridge to the development device. The development device adheres the toner on the photoconductor drum 1*a*, 1*b*, 1*c*, or 1*d*. The development unit 3*a*, 3*b*, 3*c*, or 3*d* forms a toner image by adhering the toner to an electrostatic latent image on the photoconductor drum 1*a*, 1*b*, 1*c*, or 1*d*.

The photoconductor drum 1*a*, the exposure device 2*a* and the development device 3*a* perform development of a Magenta component of an image to be printed. The photoconductor drum 1*b*, the exposure device 2*b* and the development device 3*b* perform development of a Cyan component of an image to be printed. The photoconductor drum 1*c*, the exposure device 2*c* and the development device 3*c* perform development of a Yellow component of an image to be printed. The photoconductor drum 1*d*, the exposure device 2*d* and the development device 3*d* perform development of a Black component of an image to be printed.

An intermediate transfer belt 4 is a loop-shaped image carrier (here an intermediate transfer member), and contacts the photoconductor drums 1*a* to 1*d*. Toner images on the photoconductor drums 1*a* to 1*d* are primarily transferred onto the intermediate transfer belt 4. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

A transfer roller 6 makes an incoming printing sheet contact the transfer belt 4, and secondarily transfers the toner image on the transfer belt 4 to the printing sheet. The printing sheet on which the toner image has been transferred is transported to a fuser 9, and consequently, the toner image is fixed on the printing sheet.

A roller 7 includes a cleaning brush, and removes residual toner on the intermediate transfer belt 4 by the cleaning brush contacting to the intermediate transfer belt 4 after transferring the toner image to the printing sheet and/or after toner density calibration or toner gradation calibration.

A sensor 8 irradiates the intermediate transfer belt 4 with a light beam, and detects its reflection light from a surface of the intermediate transfer belt 4 or a toner pattern on the intermediate transfer belt 4. For example, in toner gradation calibration, the sensor 8 irradiates a predetermined area (an area onto which a toner patch for calibration is transferred) on the intermediate transfer belt 4 with a light beam, detects its reflection light, and outputs an electronic signal corresponding to the received light amount.

Further, the image forming apparatus of this embodiment includes plural printing sheet cassettes 11 to 14. The printing sheet cassettes 11 and 12 are installed in a main body of the image forming apparatus, and the printing sheet cassettes 13 and 14 are installed in an option sheet feeding device that is mountable to and demountable from the main body of the image forming apparatus.

The printing sheet cassettes 11 to 14 are capable of storing printing sheets 101 to 104, and push up the printing sheets 101 to 104 using lift plates 21, 24, 31 and 34 so as to cause the printing sheets 101 to 104 to contact with pickup rollers 22, 25, 32 and 35, respectively. The printing sheets 101 to 104 on the sheet cassettes 11 to 14 are fed to sheet feeding rollers 23, 26, 33 and 36 by the pickup rollers 22, 25, 32 and 35 one by one from the tops of bunches of the printing sheets 101 to 104, respectively. The sheet feeding rollers 23, 26, 33 and 36 are rollers that transport to a sheet transportation path the printing sheets 101 to 104 one by one fed by the pickup rollers 22, 25, 32 and 35 from the sheet cassettes 11 to 14, respectively.

A transportation roller 27 is a transportation roller on a transportation path common to the printing sheets 101 to 104 transported from the printing sheet cassettes 11 to 14.

A registration roller 41 temporarily stops the printing sheet in transportation, and at a second feeding timing, transports the printing sheet to a transfer position between the intermediate transfer belt 4 and the transfer roller 6. The second feeding timing is specified by a controller 61 mentioned below so as to cause a toner image on the intermediate transfer belt 4 to be transferred to a specified position on the printing sheet.

A registration sensor 42 is installed near the registration roller 41, and is an optical sensor that detects that the printing sheet 101, 102, 103 or 104 on the transportation path reaches the registration roller 41.

A transportation sensor 43 is an optical sensor that the detects that the printing sheet 101, 102, 103 or 104 on the transportation path reaches a predetermined position (i.e. installation position of the transportation sensor 43). The transportation sensor 43 is installed on an upstream side of the registration sensor 42 in the main body of the image forming apparatus.

A transportation sensor 44 is an optical sensor that the detects that the printing sheet 103 or 104 on the transportation path reaches a predetermined position (i.e. installation position of the transportation sensor 44). The transportation sensor 44 is installed in the aforementioned option sheet feeding device.

A transportation sensor 45 is an optical sensor that the detects that the printing sheet 101, 102, 103 or 104 on the transportation path reaches a predetermined position (i.e. installation position of the transportation sensor 45). The transportation sensor 45 is installed on a downstream side of the fuser 9 in the main body of the image forming apparatus.

A bridge transportation sensor 46 is an optical sensor that the detects that the printing sheet 101, 102, 103 or 104 on the transportation path reaches a predetermined position (i.e. installation position of the bridge transportation sensor 46). The bridge transportation sensor 46 is installed on a bridge transportation path in the main body of the image forming apparatus. The bridge transportation path is a transportation path to transport the printing sheet to the finisher, and is a transportation path that branches from a main body transportation path at a position in a downstream side of the fuser 9.

Figure 2:
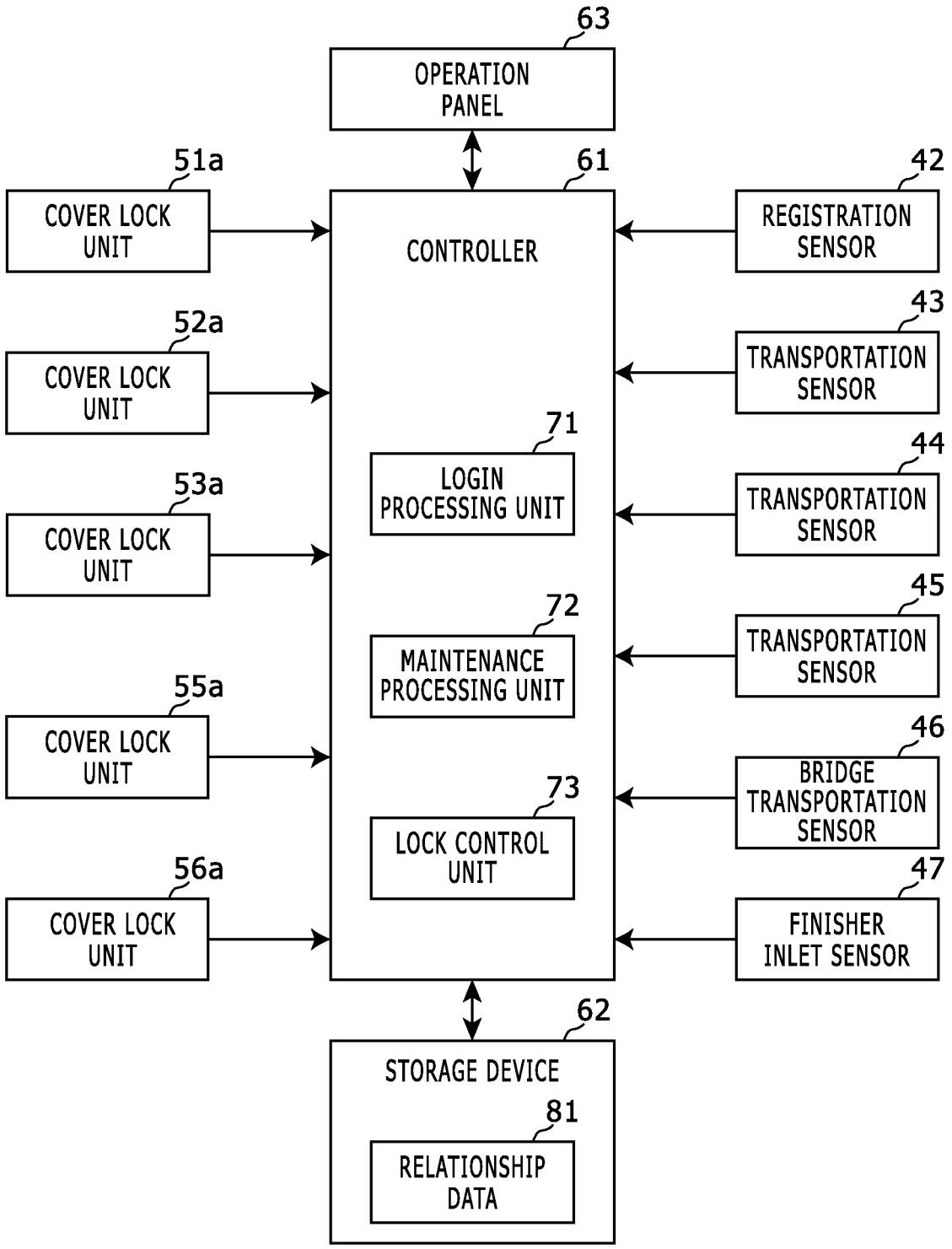
FIG. 2 shows a block diagram that indicates an electronic configuration of the image forming apparatus in the embodiment according to the present disclosure.
Figure 3:
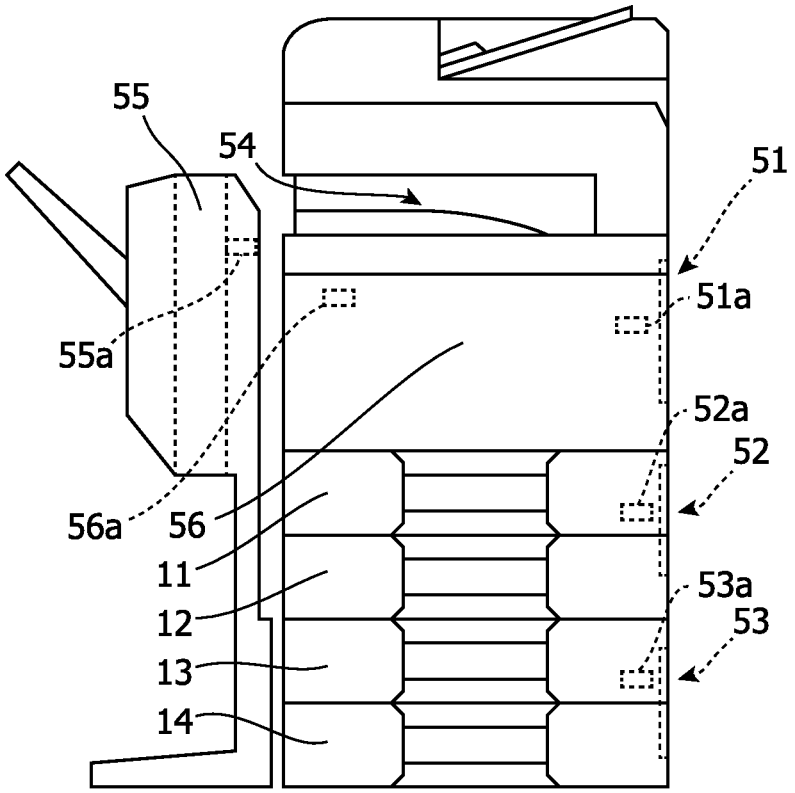
FIG. 3 shows a diagram that indicates an example of positions of covers and sensors installed on a housing of the image forming apparatus in the embodiment according to the present disclosure.

FIG. 2 shows a block diagram that indicates an electronic configuration of the image forming apparatus in the embodiment according to the present disclosure. FIG. 3 shows a diagram that indicates an example of positions of covers and sensors installed on a housing of the image forming apparatus (including a main body, an option sheet feeding device, and a finisher) in the embodiment according to the present disclosure.

As shown in FIGS. 2 and 3, this image forming apparatus further includes a finisher inlet sensor 47. The finisher inlet sensor 47 is an optical sensor that detects that the printing sheet 101, 102, 103 or 104 on the bridge transportation path reaches a predetermined position (i.e. installation position of the finisher inlet sensor 47) in a finisher mountable to and demountable from the main body of this image forming apparatus. The finisher inlet sensor 47 is installed on the bridge transportation path near a printing sheet inlet of the finisher.

Hereinafter the registration sensor, the transportation sensor, the bridge transportation sensor and the finisher inlet sensor are simply called as "sensor." As mentioned, the sensors 42 to 47 are photoelectric sensors that are installed on the sheet transportation path of the printing sheet for printing sheet detection. Each of the sensors 42 to 47 is a reflection type sensor, and includes a light emitting unit that irradiates a predetermined position on the transportation path with a measurement light, and a light receiving unit that receives reflection light from the predetermined position and outputs an output signal corresponding to the received light amount. Therefore, when a printing sheet is located at the predetermined position, the received light amount gets large, otherwise the received light amount gets small.

Further, as shown in FIGS. 2 and 3, this image forming apparatus includes plural covers 51 to 56 installed on the housing, and plural cover lock units 51*a* to 53*a*, 55*a* and 56*a*. The covers 51 to 56 are capable of being opened and closed. Each of the cover lock units 51*a* to 53*a*, 55*a* and 56*a* locks a predetermined cover among the plural covers 51 to 56 and unlocks the predetermined cover in accordance with a control signal.

The cover 51 is installed on a side face (upper side) of the main body, and the cover 52 is installed on a side face (lower side) of the main body. The cover 53 is installed on a side face of the option sheet feeding device. The cover 54 is installed over the bridge transportation path. The cover 55 is installed on a front face of the finisher. The covers 51 to 55 are covers for removing a printing sheet that stops on the transportation path due to jam or the like. The cover 56 is installed on a front face of the main body, and is a cover for replacement of the development devices 3*a* to 3*d* and/or the toner cartridges.

Each of the cover lock units 51*a* to 53*a*, 55*a* and 56*a* locks a predetermined cover among the plural covers 51 to 56 and unlocks the predetermined cover in accordance with a control signal.

For example, each of the cover lock units 51*a* to 53*a*, 55*a* and 56*a* includes an actuator that performs mechanically locking of the cover in accordance with the control signal.

In a status that the cover lock units 51*a* to 53*a*, 55*a* and 56*a* lock the covers 51 to 53, 55 and 56, the covers 51 to 53, 55 and 56 are prevented from being opened and closed by a user or a service person; and in an unlock status of the covers 51 to 53, 55 and 56, the covers 51 to 53, 55 and 56 can be opened and closed by a user or a service person.

Further, as shown in FIG. 2, this image forming apparatus includes a controller 61, a storage device 62, and an operation panel 63.

The controller 61 includes a computer, an ASIC (Application Specific Integrated Circuit) and/or the like and thereby embodies sorts of processing units with software and/or hardware, watches and controls an internal device such as the printing device as shown in FIG. 1 and performs sorts of data processing. The controller 61 controls an unshown driving source that drives the aforementioned rollers and the like, a bias circuit that induces a primary transfer bias, the development devices 3*a* to 3*d*, the exposure devices 2*a* to 2*d* and the like, and thereby performs developing, transferring and fixing the toner image, feeding a paper sheet, printing on the paper sheet, and outputting the paper sheet.

Further, the controller 61 detects a trouble (printing sheet jam, toner empty, reaching usage limit of the development devices 3*a* to 3*d* or the like) of this image forming apparatus. Specifically, in order to control transportation of each printing sheet, the controller 61 determines whether a printing sheet is located at each of the predetermined positions on the transportation path of the printing sheet on the basis of the output signals of the sensors 42 to 47, and thereby detects a printing sheet jam. Further, in a known manner, the controller 61 detects toner empty of the toner cartridge and detects reaching usage limit of the development device 3*a*, 3*b*, 3*c* and 3*d*.

The storage device 62 is a nonvolatile storage device such as flash memory. In the storage device 62, a programs, data and the like for the controller 61 are stored in advance. In this embodiment, in the storage device 62, relationship data 81 is stored.

The operation panel 63 includes a display device (a liquid crystal display or the like) that displays an operation screen or the like to a user and an input device (touch panel, hard key and/or the like) that detects a user operation.

Further, the controller 61 acts as a login processing unit 71, a maintenance processing unit 72, and a lock control unit 73.

The login processing unit 71 displays a login screen on the operation panel 63 and detects a user operation to input user authentication information (a user ID and a password) to the login screen with the operation panel 63. Upon detecting the user authentication information, the login processing unit 71 performs user authentication on the basis of the inputted user authentication information. If the user authentication is succeeded, the login processing unit 71 displays on the operation panel 63 a menu screen to use sorts of functions of this image forming apparatus. A user whose user authentication is succeeded operates the menu screen and thereby uses the functions until the user logs out.

The maintenance processing unit 72 performs authentication of a service person on the basis of a specific operation (e.g. inputting a specific password or the like) to the operation panel 63. If the authentication is succeeded, the maintenance processing unit 72 allows a maintenance operation instructed by the service person. If the authentication is succeeded, the maintenance processing unit 72 performs the maintenance operation (reading out a log, changing a setting item or the like) in accordance with an operation of the service person.

The lock control unit 73 controls the cover lock units 51*a* to 53*a*, 55*a* and 56*a* and thereby changes a status of the cover 51, 52, 53, 55 or 56 from one to the other among lock status and unlock status.

The aforementioned plural covers 51 to 53, 55 and 56 include one or more first covers, one or more second covers, and one or more third covers. The first cover (here, the cover 54) is a cover on which the cover lock unit 51*a*, 52*a*, 53*a*, 55*a* or 56*a* is not installed. The second cover (here, the covers 52, 53, 55 and 56) is a cover on which the cover lock unit 51*a*, 52*a*, 53*a*, 55*a* or 56*a* is installed and that a predetermined user and a service person are allowed to unlock. The third cover (here, the cover 51) is a cover on which the cover lock unit 51*a*, 52*a*, 53*a*, 55*a* or 56*a* is installed and that the service person is allowed to unlock. Further, the lock control unit 73 determines whether the lock control unit 73 unlocks the second cover or not on the basis of a user level of either a user who is in login status (i.e. login user) or an authenticated user (whose user authentication is succeeded after detecting a trouble).

The user level is determined on the basis of a user registration data (not shown) used in the user authentication. The user registration data includes user authentication information (a user ID and a password) and user level information on each registered user. The user registration data has been stored in the storage device 62 or a server (not shown), and is read out when required.

Further, the relationship data 81 is data that indicates a relationship between each second cover and a user level that allows to unlock this second cover. The relationship data 81 is stored in the storage device 62 in advance. The lock control unit 73 determines (a) a user level of either a user who is in login status or an authenticated user, (b) determines on the basis of the relationship data 81 the second cover that the determined user level allows to unlock, and (c1) performs unlocking the determined second cover and (c2) does not perform unlocking the second cover other than the second cover that the determined user level allows to unlock.

Figure 4:
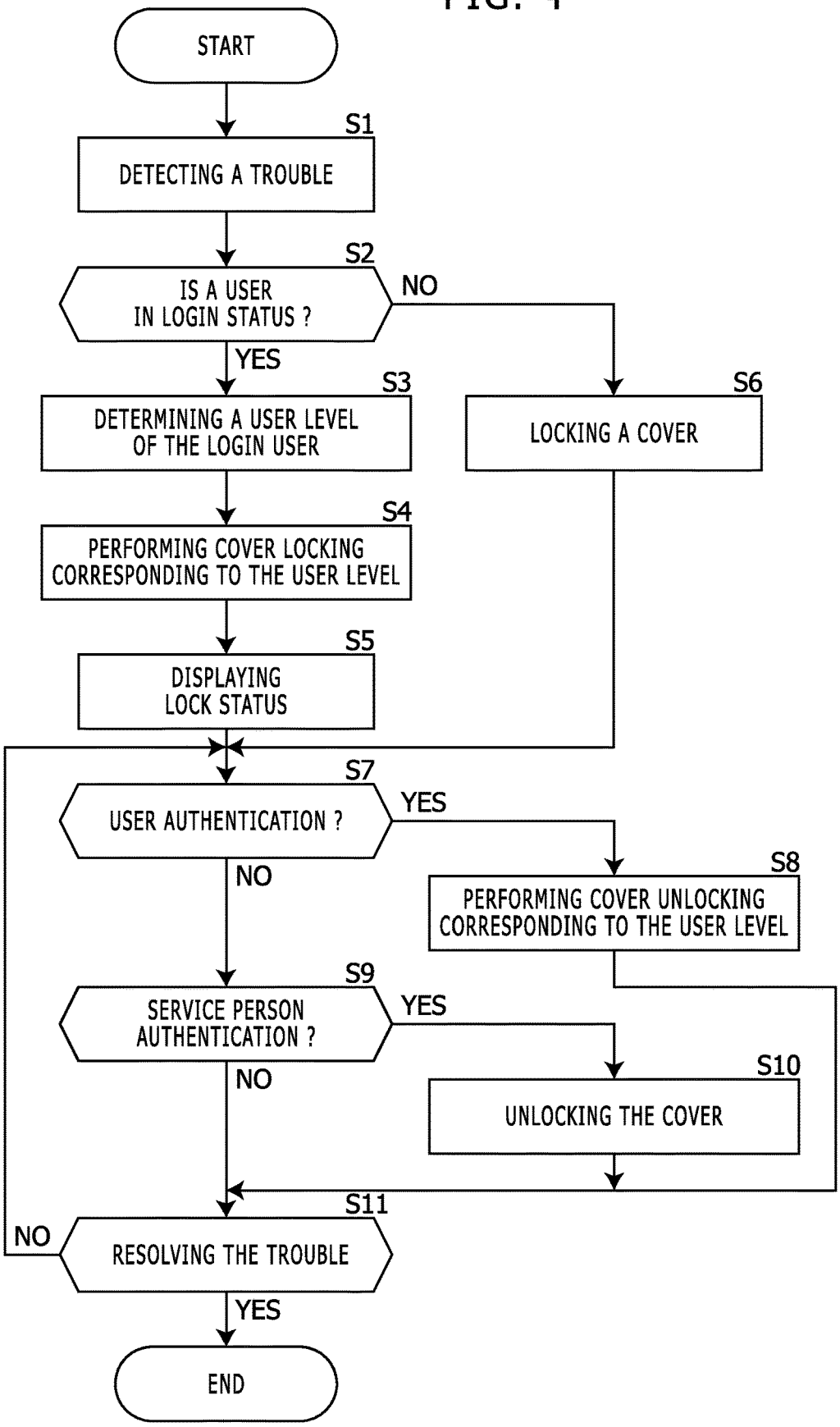
FIG. 4 shows a flowchart that explains a behavior of the image forming apparatus shown in FIGS. 1 to 3.

The following part explains a behavior of the aforementioned image forming apparatus. FIG. 4 shows a flowchart that explains a behavior of the image forming apparatus shown in FIGS. 1 to 3.

Upon detecting a trouble (for example, a jam in a copy job or a jam in a print job) in this image forming apparatus (in Step S1), the lock control unit 73 determines whether there is a user in a login status or not (in Step S2); and if there is a user in a login status, then the lock control unit 73 determines a user level of the login user (in Step S3), and locks all covers except for a cover that the determined user level allows to unlock among the covers 51 to 53, 55 and 56 using the cover lock units 51*a* to 53*a*, 55*a* and 56*a* (in Step S4). Subsequently, on the operation panel 63, the lock control unit 73 displays a message that indicates the aforementioned one or more covers in lock status (in Step S5).

Contrarily, if there are no users in a login status when the trouble is detected (for example, when the trouble is detected in a print job requested from a remote host device), then the lock control unit 73 locks all the covers to 53, 55 and 56 (in Step S6). Subsequently, on the operation panel 63, the lock control unit 73 displays a message that indicates the aforementioned one or more covers in lock status (in Step S5).

As mentioned, if there is a cover in lock status after the detection of the trouble, then controller 61 stops receiving a job request until the trouble is resolved.

The operation panel 63 displays a screen that includes the message that indicates one or more covers in lock status, and in this screen, an input field for inputting user authentication information and an input field for inputting service person authentication information are displayed together.

When user authentication information is inputted to the input field for inputting user authentication information by a user with the operation panel 63, the lock control unit 73 performs user authentication based on the inputted user authentication information (in Step S7); and if the user authentication is succeeded, then the lock control unit 73 determines a user level of the user and unlocks a cover that is in lock status and the determined user level allows to unlock among the covers 51 to 53, 55 and 56 using the cover lock unit 51*a* to 53*a*, 55*a* and 56*a* (in Step S8).

When service person authentication information is inputted to the input field for inputting service person authentication information by a service person with the operation panel 63, the lock control unit 73 performs service person authentication based on the inputted service person authentication information (in Step S9); and if the service person authentication is succeeded, then the lock control unit 73 unlocks all covers that are in lock status among the covers 51 to 53, 55 and 56 using the cover lock unit 51*a* to 53*a*, 55*a* and 56*a* (in Step S10).

Further, when the user or the service person finishes an operation for resolving the trouble, the controller 61 detects that the trouble has been resolved (in Step S11), and terminates this process.

As mentioned, in the aforementioned embodiment, each of the cover lock units 51*a* to 53*a*, 55*a* and 56*a* locks a predetermined cover among the plural covers 51 to 56 and unlocks the predetermined cover in accordance with a control signal. The lock control unit 73 controls the cover lock units 51*a* to 53*a*, 55*a* and 56*a* and thereby changes a status of the cover 51, 52, 53, 55 or 56 from one to the other among lock status and unlock status. The aforementioned plural covers 51 to 53, 55 and 56 include one or more first covers, one or more second covers, and one or more third covers. The first cover is a cover on which the cover lock unit 51*a*, 52*a*, 53*a*, 55*a* or 56*a* is not installed (i.e. a cover that is not locked when a trouble is detected). The second cover is a cover on which the cover lock unit 51*a*, 52*a*, 53*a*, 55*a* or 56*a* is installed and that a predetermined user and a service person are allowed to unlock (i.e. a cover that is locked when a trouble is detected but allowed to be opened and closed by a specific user and a service person). The third cover is a cover on which the cover lock unit 51*a*, 52*a*, 53*a*, 55*a* or 56*a* is installed and that the service person is allowed to unlock (i.e. a cover that is locked when a trouble is detected and is not allowed to be opened and closed by any users but allowed to be opened and closed by a service person). Further, the lock control unit 73 determines whether the lock control unit 73 unlocks the second cover or not on the basis of a user level of either a user who is in login status or an authenticated user.

Consequently, locking and unlocking of the covers 51 to 53, 55 and 56 are properly performed when a trouble is detected.

The covers 51 to 53, 55 and 56 is classified in accordance with locations thereof into (a) a cover that there are no problems even if any user touches the inside through this cover, (b) a cover that there are no problems even if a user who is familiar to a structure of the apparatus touches the inside through this cover but it is favorable that a user who is not familiar to a structure of the apparatus does not touch the inside the inside through this cover and (c) a cover that it is favorable that no users touch the inside the inside through this cover. These covers are classified into the aforementioned first, second and third covers in advance, and a user who is not familiar to a structure of the apparatus and a user who is familiar to a structure of the apparatus are classified with the aforementioned user levels in advance, and thereby locking and unlocking of the covers 51 to 53, 55 and 56 are properly performed in accordance with locations of the covers and the user level when a trouble is detected.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the cover 51 (i.e. a specific cover for removing a printing sheet that jams in the fuser 9) may be set as the second cover; and the lock control unit 73 may (a) not allow the user to unlock the cover 51 regardless of the user level and allows the service person to unlock the cover 51 if a temperature of the fuser 9 is equal to or higher than a predetermined value when a printing sheet jam occurs in the fuser 9, and (b) allows the user to unlock the cover 51 in accordance with the user level and allows the service person to unlock the cover 51 if the temperature of the fuser 9 is lower than the predetermined value when a printing sheet jam occurs in the fuser 9. The temperature of the fuser 9 is detected using a temperature sensor, for example.

Further, in the aforementioned embodiment, the user authentication and the service person authentication may be performed by an external authentication server (not shown). In such a case, the controller 61 (a) transmits the authentication information of a user or a service person to the authentication server using a network interface (not shown), and thereby causes the authentication server to perform the user authentication or the service person authentication, (b) receives an authentication result from the authentication server and if the authentication is succeeded, then receives a user level of the user together with the authentication result.

What is claimed is:

1. An image forming apparatus, comprising:

plural covers installed on a housing, the plural covers capable of being opened and closed;

plural cover lock units configured to lock a predetermined cover among the plural covers and unlock the predetermined cover in accordance with a control signal; and a lock control unit configured to control the cover lock units and thereby change a status of the cover from one to the other among lock status and unlock status;

wherein the plural covers include a first cover, a second cover, and a third cover, the first cover on which the cover lock unit is not installed, the second cover on which the cover lock unit is installed and that a predetermined user and a service person are allowed to unlock, and the third cover on which the cover lock unit is installed and that the service person is allowed to unlock and the predetermined user is not allowed to unlock;

the lock control unit determines whether the lock control unit unlocks the second cover or not on the basis of a user level of either a current user who is in login status or an additional user;

wherein the apparatus will lock the plural cover lock units in accordance with the user level of the current user who is in login status; the apparatus will display a screen on a display that allows the additional user to login and the lock control unit will lock and unlock the plural cover lock units in accordance with the user level of the additional user.

2. The image forming apparatus according to claim 1, further comprising a storage device in which relationship data is stored, the relationship data indicating a relationship between the second cover and a user level that allows to unlock this second cover; and the lock control unit determines (a) a user level of either a user who is in login status or an authenticated user, (b) determines on the basis of the relationship data the second cover that the determined user level allows to unlock, and (c1) performs unlocking the determined second cover and (c2) does not perform unlocking the second cover other than the second cover that the determined user level allows to unlock.

3. An image forming apparatus, comprising:

plural covers installed on a housing, the plural covers capable of being opened and closed;

plural cover lock units configured to lock a predetermined cover among the plural covers and unlock the predetermined cover in accordance with a control signal;

a fuser;

a lock control unit configured to control the cover lock units and thereby change a status of the cover from one to the other among lock status and unlock status;

wherein the plural covers include a first cover, a second cover, and a third cover, the first cover on which the cover lock unit is not installed, the second cover on which the cover lock unit is installed and that a predetermined user and a service person are allowed to unlock, the third cover on which the cover lock unit is installed and that the service person is allowed to unlock;

the lock control unit determines whether the lock control unit unlocks the second cover or not on the basis of a user level of either a user who is in login status or an authenticated user wherein the second cover includes a specific cover for removing a printing sheet that jams in the fuser; and the lock control unit (a) does not allow the user to unlock the specific cover regardless of the user level and allows the service person to unlock the specific cover if a temperature of the fuser is equal to or higher than a predetermined value when a printing sheet jam occurs in the fuser, and (b) allows the user to unlock the specific cover in accordance with the user level and allows the service person to unlock the specific cover if the temperature of the fuser is lower than the predetermined value when a printing sheet jam occurs in the fuser.

* * * * *